US007119490B2

(12) United States Patent
Van Den Hoek et al.

(10) Patent No.: US 7,119,490 B2
(45) Date of Patent: Oct. 10, 2006

(54) STARTER FOR MINIMIZING DAMAGE TO LAMP ELECTRODES OF A DISCHARGE LAMP AT STARTUP

(75) Inventors: Willem Jacobus Van Den Hoek, Eindhoven (NL); Marco Haverlag, Eindhoven (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 0 days.

(21) Appl. No.: 10/515,742

(22) PCT Filed: Jun. 4, 2003

(86) PCT No.: PCT/IB03/02472

§ 371 (c)(1),
(2), (4) Date: Nov. 24, 2004

(87) PCT Pub. No.: WO03/103344

PCT Pub. Date: Dec. 11, 2003

(65) Prior Publication Data

US 2005/0253535 A1 Nov. 17, 2005

(30) Foreign Application Priority Data

May 30, 2002 (EP) ..... 02077132

(51) Int. Cl.
*H05B 41/14* (2006.01)

(52) U.S. Cl. ..... 315/105; 315/307; 315/209 R; 315/DIG. 5

(58) Field of Classification Search ..... 315/291, 315/224, 225, 307, 209 R, 105, 106, DIG. 2, 315/DIG. 5, DIG. 7
See application file for complete search history.

(56) References Cited

U.S. PATENT DOCUMENTS 4,503,359 A 3/1985 Watanabe et al. ..... 315/105
5,477,109 A * 12/1995 Chermin et al. ..... 315/105
5,537,010 A * 7/1996 Johnson et al. ..... 315/DIG. 7
5,652,481 A * 7/1997 Johnson et al. ..... 315/307
5,736,817 A * 4/1998 Rothenbuhler et al. ..... 315/106

FOREIGN PATENT DOCUMENTS

EP 0471228 A1 2/1992

* cited by examiner

*Primary Examiner*—Tuyet Vo
*Assistant Examiner*—Ephrem Alemu

(57) ABSTRACT

A starter for a discharge lamp is disclosed for operation from an AC supply voltage. The starter comprises a first terminal for connection to a first lamp electrode, a second terminal for connection to a second lamp electrode, a switching element coupled between the first and second lamp electrode during operation, a control circuit coupled to a control electrode of the switching element for generating a control signal for rendering the switching element conductive and thereby allowing an AC preheat current with period T to flow through the lamp electrodes and for subsequently rendering the switching element non-conductive to generate an ignition voltage pulse between the lamp electrodes. The starter advantageously inflicts only a relatively small amount of damage to the electrodes of the discharge lamp by means of ignition voltage pulses that are applied to the discharge lamp before its electrodes are sufficiently heated (i.e., during a warm-up period) by applying the ignition voltage pulses in the direct vicinity of a zero-crossing of the AC preheat current.

7 Claims, 1 Drawing Sheet

STARTER FOR MINIMIZING DAMAGE TO LAMP ELECTRODES OF A DISCHARGE LAMP AT STARTUP

Figure 1:
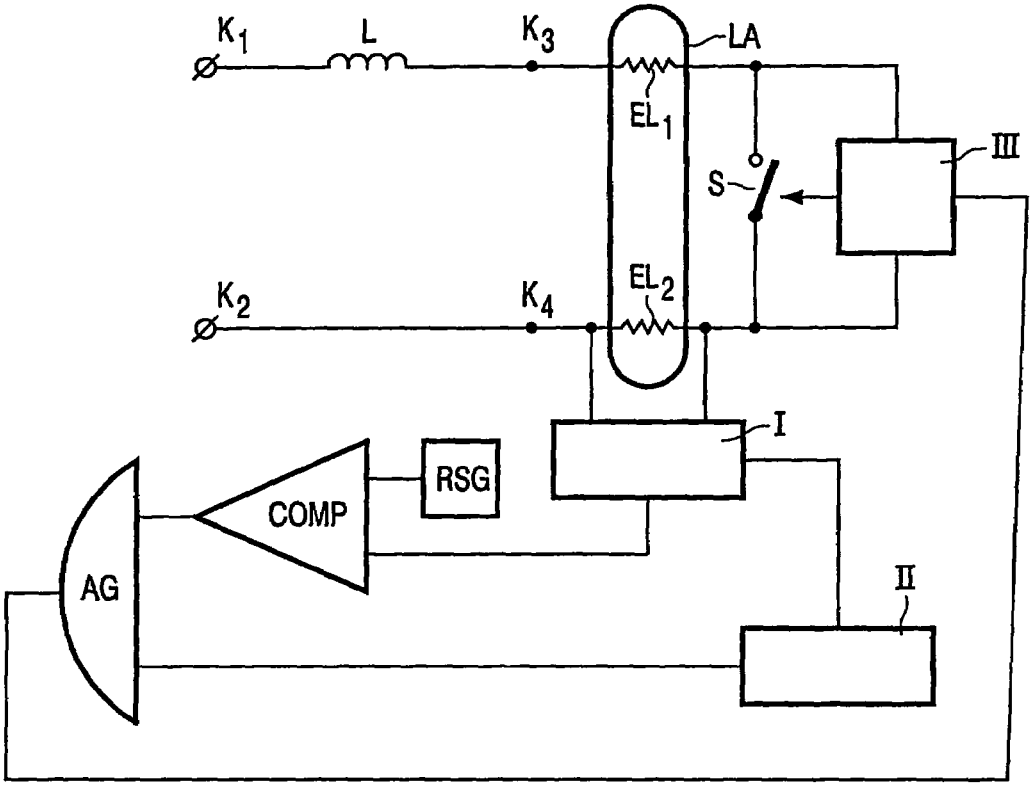

This application is the U.S. National Stage of International Application PCT/IB/02472 filed Jun. 4, 2003 which claims priority of European Patent Office (EPO) 02077132.5 filed May 30, 2002.

The invention relates to a starter for a discharge lamp suitable for operation from an AC supply voltage, comprising

- a first terminal for connection to a first lamp electrode,
- a second terminal for connection to a second lamp electrode,
- a switching element that is coupled between the first and the second lamp electrode during operation,
- a control circuit coupled to a control electrode of the switching element for generating a control signal for rendering the switching element conductive and thereby allowing an AC preheat current with a period T to flow through the lamp electrodes and for subsequently rendering the switching element non-conductive to generate an ignition voltage pulse between the lamp electrodes.

Such a starter is well known. During operation the first and second terminals of the known starter are connected to respective electrodes of the discharge lamp. A ballasting choke is connected in series with the lamp and this series arrangement is connected to poles of the AC supply voltage. When the control circuit renders the switching element conductive, an AC preheat current flows through the ballasting choke and the lamp electrodes. When the switching element is rendered non-conductive by the control signal, the preheat current is thereby switched off and the ballasting choke generates an ignition voltage pulse. When the lamp electrodes have been heated by the preheat current to a high enough temperature, the ignition voltage pulse will successfully ignite the discharge lamp. However, as is very often the case in practice, when the electrodes are not yet heated enough by means of the preheat current, the ignition voltage pulse will not ignite the discharge lamp. When the ignition attempt is unsuccessful, the control circuit will once more render the switching element conductive for a certain time lapse and subsequently generate another ignition voltage pulse. This cycle is repeated until the lamp ignites.

It has been known for a long time that the ignition voltage pulses that are delivered to the discharge lamp, when its electrodes are still too cold to allow ignition, damage the electrodes and therefore decrease the life time of the discharge lamp. More in particular the ignition voltage pulses cause removal of emitter material from the electrodes.

The invention aims to provide a starter that inflicts only a relatively small amount of damage to the electrodes of a discharge lamp by means of ignition voltage pulses that are applied to the discharge lamp before its electrodes are sufficiently heated.

A starter as mentioned in the opening paragraph is therefore characterized in that the control circuit comprises a synchronization circuit coupled to the discharge lamp during operation of the starter for synchronizing the control signal and the AC preheat current in such a way that the time at which the control signal renders the switching element non-conductive differs less than 0.08*T from a zero-crossing of the preheat current.

The inventors of the invention disclosed in this application have found that the damage that ignition voltage pulses do to the lamp electrodes depends strongly on the amplitude of the preheat current when the ignition voltage pulse is applied. The inventors have found more in particular that the damage done to the electrodes (or in other words the amount of emitter material removed) is bigger when the momentary amplitude of the electrode preheat current is higher. This is induced by the occurrence of so called vapor arc modes. It was further found that hardly any damage to the electrodes resulted, when the ignition voltage pulse was applied in the direct vicinity of a zero crossing of the preheat current. In this latter case vapor arc modes are to a large extent avoided and replaced by a glow discharge mode that causes far less or no damage. The synchronization circuit ensures that ignition voltage pulses are only generated by a starter according to the invention when the momentary amplitude of the preheat current is rather low.

It be mentioned that, if the switching element is rendered non-conductive when the preheat current is zero, no ignition voltage pulse results, since the ballast choke contains no energy. Therefor the moment at which the switching element is rendered non-conductive may not coincide with a zero-crossing of the preheat current.

Good results have been obtained for starters according to the invention, wherein the time at which the control signal renders the switching element non-conductive differs less than 0.04*T, preferably less than 0.027*T from a zero-crossing of the preheat current. It was found that in case the time at which the control signal renders the switching element non-conductive differs less than 0.04*T from a zero-crossing of the preheat current vapor arc modes are avoided for most types of fluorescent lamps. It was further found that in case the time at which the control signal renders the switching element non-conductive differs less than 0.027*T from a zero-crossing of the preheat current, vapor arc modes are completely avoided in virtually every type of fluorescent lamp.

In a preferred embodiment of a starter according to the present invention, the control signal controls the switching element periodically according to a switching cycle in which the switching element is first rendered conductive for a predetermined time lapse and subsequently rendered non-conductive to generate an ignition voltage pulse and wherein the time duration SC of a switching cycle equals a whole number of half periods of the preheat current. In case this preferred embodiment is used in combination with a discharge lamp with electrodes that have a relatively low heat capacity, only a few switching cycles or may be even one cycle will suffice to heat the electrodes to a temperature that is high enough to allow ignition of the lamp. As a result the ignition of the lamp is not unnecessarily postponed and overheating of the electrodes to a temperature at which damage to the electrodes, due to evaporation of emitter, can occur is avoided. On the other hand if the preferred embodiment is used in combination with a lamp with electrodes that have a relatively high heat capacity, many switching cycles will be needed to heat the electrodes to a temperature that allows ignition of the lamp. At the end of each switching cycle an ignition voltage pulse is generated. Although the first ignition voltage pulses are not able to ignite the lamp, they do not damage the electrodes either. The ignition voltage pulse that is generated at the end of the cycle in which the electrodes reach a proper temperature for ignition ignites the lamp. In case the time duration of a cycle is properly chosen, different lamps having electrodes with different heat capacities will be ignited quickly after the proper electrode temperature is reached so that overheating of the electrodes is prevented. At the same time the voltage ignition pulses that are generated before the electrodes have reached their proper temperature do not damage the electrodes. It has been found in practice that a wide range of discharge lamps could be quickly ignited while overheating of the electrodes was avoided in case 0.10 sec≦SC≦0.20 sec.

It has been found that the synchronization circuit can be realized in a simple and effective way when it comprises means for rendering the switching element non-conductive when the momentary amplitude of the preheat current has a predetermined reference value. Preferably the synchronization circuit comprises means for adjusting the predetermined reference value at a predetermined fraction of the maximum amplitude of the preheat current. These latter means assure that the ignition pulse is generated at the same time, irrespective of the maximum amplitude of the preheat current or, in other words, irrespective of the type of discharge lamp.

Another simple and effective way to realize the synchronization circuit to equip it with means for rendering the switching element non-conductive a predetermined time lapse after a zero-crossing of the preheat current.

An embodiment of a starter according to the invention will be explained making reference to a drawing. In the drawing FIG. 1 shows an embodiment of a starter according to the invention connected to a discharge lamp La that is placed in series with a ballast choke, and FIG. 2 shows the amount of emitter material that is removed from the electrodes of a fluorescent lamp for different ways of igniting the fluorescent lamp as a function of time.

Figure 2:
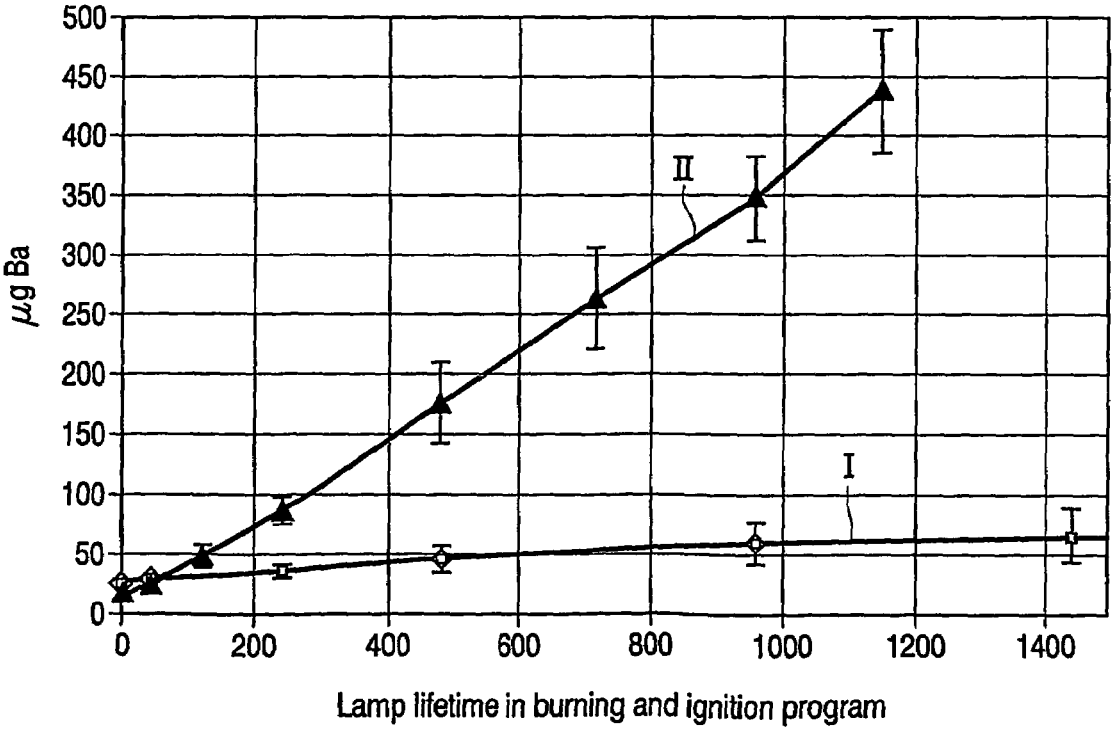

In FIG. 1 K1 and K2 are terminals for connection to a voltage source that supplies an AC supply voltage. A first side of a ballast choke L is connected to terminal K1. A second side of ballast choke L is connected to a first terminal K3 that in turn is connected to a first end of electrode E11. Electrode E11 is a first electrode of discharge lamp La and electrode E12 is a second electrode of discharge lamp La A first end of electrode E12 is connected to terminal K2 via second terminal K4. A second end of electrode E11 is connected to a second end of electrode E12 by means of a switching element S. The first and the second end of electrode E12 are connected with respective input terminals of circuit part I. Circuit part I is a circuit part for generating a signal that represents the momentary amplitude of the preheat current. Circuit part I comprises a rectifier so that the signal generated by it is positive, irrespective of the direction of the preheat current. A first output terminal of circuit part I is connected with a first input terminal of a comparator COMP. A second input terminal of comparator COMP is connected with an output terminal of circuit part RSG. Circuit part RSG is a circuit part for generating a reference signal Vref. The reference signal equals a predetermined value of the amplitude of the preheat current. This predetermined value is chosen so that the amplitude of the preheat current equals the predetermined value at a time that differs less than 0.027*T from the nearest zero-crossing of the preheat current. In this embodiment the predetermined value is chosen equal to the amplitude of the preheat current at a time 0.02*T after a zero crossing of the preheat current. Circuit part RSG may be coupled to electrode E12 (this coupling is not shown in FIG. 1) for sampling the maximal amplitude of the preheat current and adjusting the value of the reference signal Vref at a predetermined fraction of the maximum amplitude of the preheat current. An output terminal of comparator COMP is connected to a first input terminal of and-gate AG. A second input terminal of and-gate AG is connected with an output terminal of circuit part II. Circuit part II is a timer. A second output terminal of circuit part I is connected with an input terminal of circuit part II. An output terminal of and-gate AG is coupled to a first input terminal of circuit part III for controlling the conductive state of switching element S. An output terminal of circuit part III is therefor coupled to a control electrode of switching element S. In FIG. 1 this coupling is indicated by means of an arrow. A second input terminal of circuit part III is connected with the second end of electrode E11 and a third input terminal of circuit part I is connected with the second end of electrode E12. Circuit parts I, II, III, RSG, comparator COMP and and-gate AG together with switch S form a starter according to the invention. Circuit parts I, II, III, RSG, comparator COMP and and-gate AG together form a control circuit for generating a control signal for rendering the switching element conductive and thereby allowing an AC preheat current with a period T to flow through the lamp electrodes and for subsequently rendering the switching element non-conductive to generate an ignition voltage pulse between the lamp electrodes. Circuit parts I and RSG and comparator COMP together form a synchronization circuit for synchronizing the control signal and the low frequency preheat current The operation of the circuitry shown in FIG. 1 is as follows.

When terminals K1 and K2 are connected to a voltage source that supplies an AC supply voltage, switching element S is rendered conductive by circuit part III and an AC preheat current with a period T flows through ballast choke L, electrode E11, switching element S and electrode E12. A first switching cycle is started in which circuit part II is activated and starts timing a time interval that is equal to a whole number of half periods of the preheat current. In the embodiment shown in FIG. 1 this whole number equals 15 so that the timer times a time interval of 0.15 sec in case the frequency of the AC supply voltage is 50 Hz. When this time interval is timed out the voltage at the output terminal of circuit part II changes from low to high and stays high during a time lapse equal to T/2. Circuit part II automatically starts timing again as soon as it has timed out. Circuit part I generates a signal that represents the momentary amplitude of the preheat current and circuit part RSG generates a reference signal Vref. When the signal generated by circuit part I is lower than the reference signal Vref the voltage at the output terminal of comparator COMP is at a high value, otherwise the voltage at the output terminal of comparator COMP is at a low value. When the voltage at both input terminals of and-gate AG is high the voltage at the output terminal of and-gate AG is high, otherwise this voltage is low. In other words the voltage at the output terminal of and-gate AG is only high when two conditions are met: the timer has timed out and the amplitude of the preheat current is lower than a predetermined value. When both these conditions are met, circuit part III renders the switching element S non-conductive. As a result the ballast choke L generates an ignition voltage pulse over the lamp. Since the amplitude of the preheat current is approximately equal to the reference value and the reference value is chosen very low, the occurrence of a vapor arc is effectively prevented and virtually only glow discharges occur in the lamp as a result of the ignition voltage pulse. As a result the ignition voltage pulse hardly damages the electrodes even when it occurs before the electrodes are warm enough to allow ignition of the lamp. In the latter case, the lamp will not ignite as a result of the ignition pulse. Circuit part III measures the voltage over the lamp after the ignition pulse. If this voltage has not dropped as a result of the ignition pulse, the circuit part III renders the switching element S once more conductive and a further switching cycle starts. This is repeated until the lamp ignites. Since an ignition voltage pulse is generated every 0.15 second, the electrodes of the lamp will not be overheated.

In an experiment fluorescent lamps were operated in the following way: they were ignited, burned stationarily for 15 minutes, were extinguished and ignited again 5 minutes later. This cycle was continuously repeated. The ignition event consisted of a series of 5 ignition voltage pulses on the almost cold electrodes, followed by a final ignition using proper preheating. Fluorescent lamps belonging to a first group were subjected to ignition voltage pulses in the vicinity of a zero-crossing of the preheat current. In fact each pulse was applied 0.02*T after a zero-crossing after about four half-periods of the preheat current. One second later another four half periods of preheat current were applied followed by the next pulse. Fluorescent lamps belonging to a second group were subjected to ignition voltage pulses 0.25*T after the zero-crossing. The emitter material used in these fluorescent lamps contained radio-active barium. This allowed the measurement of the depletion of emitter material as a function of time without having to destruct the fluorescent lamps. The results of these measurements are presented in FIG. 2. FIG. 2 shows the amount of barium expressed in μg that is removed from the electrodes of the lamps as a function of the length of time during which the lamps have been going through the cycle described at the beginning of this paragraph. Curve I presents the results for the first group of lamps. It can be seen that emitter depletion is taking place at a very slow rate. In fact it has been found that emitter depletion is taking place at the same rate as in fluorescent lamps that are burning continuously. Curve II represents the results for the second group of lamps. It can be seen that emitter depletion is taking place at a much higher rate so that the lamp life is considerably shortened.

The invention claimed is:

1. Starter for a discharge lamp suitable for operation from an AC supply voltage, comprising a first terminal for connection to a first lamp electrode, a second terminal for connection to a second lamp electrode, a switching element that is coupled between the first and the second lamp electrode during operation of the starter, a control circuit coupled to a control electrode of the switching element for generating a control signal for rendering the switching element conductive and thereby allowing an AC preheat current with a period T to flow through the lamp electrodes and for subsequently rendering the switching element non-conductive to generate an ignition voltage pulse between the lamp electrodes, characterized in that the control circuit is operable from the point in time at which the AC preheat current begins to flow through the lamp electrodes and comprises a synchronization circuit coupled to the discharge lamp during operation of the starter for synchronizing the control signal and AC preheat current in such a way that the time at which the control signal renders the switching element non-conductive differs less than 0.08*T from a zero-crossing of the preheat current.

2. Starter according to claim 1, wherein the time at which the control signal renders the switching element non-conductive differs less than 0.04*T from a zero-crossing of the preheat current.

3. Starter according to claim 1, wherein control circuit comprises means for controlling the switching element periodically according to a switching cycle in which the switching element is first rendered conductive for a predetermined time lapse and subsequently rendered non-conductive to generate an ignition voltage pulse and wherein the time duration SC of a switching cycle equals a whole number of half periods of the preheat current.

4. Starter according to claim 3, wherein $0.10\ \text{sec} \leqq SC \leqq 0.20\ \text{sec}$.

5. Starter according to claim 1, in which the synchronization circuit comprises means for rendering the switching element non-conductive when the momentary amplitude of the preheat current has a predetermined reference value.

6. Starter according to claim 5, in which the synchronization circuit comprises means for adjusting the predetermined reference value at a predetermined fraction of the maximum amplitude of the preheat current.

7. Starter according to claim 1, in which the synchronization circuit is equipped with means for rendering the switching element non-conductive a predetermined time lapse after a zero-crossing of the preheat current.

* * * * *